United States Patent [19]

Munzer et al.

[11] 4,197,735

[45] Apr. 15, 1980

[54] BLOOD SEDIMENTATION RATE TEST MEANS

[75] Inventors: Robert A. Munzer; Benjamin F. Weiner, both of Glens Falls, N.Y.

[73] Assignee: Chase Instruments Corporation, Poultney, Vt.

[21] Appl. No.: 958,264

[22] Filed: Nov. 6, 1978

[51] Int. Cl.[2] ..... B01L 11/00

[52] U.S. Cl. ..... 73/61.4; 73/425.4 R; 422/100; 422/103; 210/DIG. 23

[58] Field of Search ..... 73/61.4, 425.6, 425.4 R, 73/53, 61 R; 23/100, 103, 99; 210/359, DIG. 23

[56] References Cited

U.S. PATENT DOCUMENTS

| | | | |
|---|---|---|---|
| 3,512,940 | 5/1970 | Shapiro | 73/61 R X |
| 3,586,064 | 6/1971 | Brown et al. | 73/425.4 R X |
| 3,799,342 | 3/1974 | Greenspan | 210/359 X |
| 3,832,141 | 8/1974 | Haldopoulous | 210/DIG. 23 X |
| 3,837,376 | 9/1974 | Brown et al. | 73/425.4 R X |
| 3,846,077 | 11/1974 | Ohringer | 73/425.6 X |
| 3,954,614 | 5/1976 | Wright | 210/359 X |
| 3,955,423 | 5/1976 | Ohringer | 73/425.4 R X |
| 3,969,250 | 7/1976 | Farr | 210/DIG. 23 X |
| 4,037,464 | 7/1977 | Wenander | 73/61.4 |
| 4,057,499 | 11/1977 | Buono | 210/359 X |

*Primary Examiner*—Gerald Goldberg
*Assistant Examiner*—Joseph W. Roskos
*Attorney, Agent, or Firm*—Stoll and Stoll

[57] ABSTRACT

Means for conducting a blood sedimentation rate test in the primary blood collecting vessel. The invention provides a plunger for said primary blood collecting vessel, a calibrated measuring tube connected to said plunger, and pressure actuated, normally closed valve means in said plunger operative between the blood collecting vessel and the calibrated measuring tube. In the operation of this device, blood is transferred directly from the primary blood collecting vessel to the calibrated measuring tube without intermediate handling.

5 Claims, 7 Drawing Figures

BLOOD SEDIMENTATION RATE TEST MEANS

BACKGROUND OF THE INVENTION a. Field of the Invention

This invention is used in hospital and other medical laboratories where hematology tests are conducted.

b. Prior Art

The closest prior patent art known to applicants consists of the following United States patents:

| Patent No. | Name | Issue Date |
|---|---|---|
| 703,101 | Ware | June 24, 1902 |
| 2,237,213 | Brown | April 1, 1941 |
| 2,941,869 | Brown et al. | June 21, 1960 |
| 2,965,255 | Gerarde | December 20, 1960 |
| 3,203,251 | Robinson | August 31, 1965 |
| 3,938,392 | Rodrigues | February 17, 1976 |

In addition to the above cited patent art there is in used today blood sedimentation rate test means which is sold under the trademark DISPETTES, made in Switzerland by Guest Medical and sold in the United States by Ulster Scientific Inc. of Highland, New York and sold in Canada by Serum International of Montreal, Canada. It is believed that the DISPETTES are the closest prior art relative to the present invention.

SUMMARY OF THE INVENTION

The principal object of the invention is to provide means for conducting a blood sedimentation rate test in the primary blood collecting vessel, that is, the vessel which receives the blood directly from the human body. Illustrative of the several kinds of primary blood collecting vessels in general use is the vessel which is known as a "vacuum blood collection tube" or "evacuated specimen tube". It is in the primary blood collecting vessel the blood is collected, introduced into a calibrated measuring tube, and there allowed to settle in the performance of the blood sedimentation rate test. It is of course understood that the blood may be modified with additives such as anticoagulants before the sedimentation rate test is conducted.

The present invention enables laboratory technicians to avoid handling or exposing themselves to infected blood. Hepatitis, for example, can be transmitted to the laboratory technician by exposure to an infected blood sample. Such exposure is obviated by the invention.

In the operation of this invention, blood is drawn directly into a primary blood collecting vessel by conventional means. An anticoagulant or other additive is then added to the blood in the primary blood collecting vessel, also by conventional means. The collected blood itself is neither handled nor transferred to another vessel. A plunger supporting a calibrated measuring tube and closely fitting the primary blood vessel is then inserted into such vessel, the measuring tube itself being used as a holder or handle for this purpose. Valve means is provided in the plunger and it will be understood that such valve means is operative between the blood collecting vessel and measuring tube. This valve means is normally closed but it is pressure sensitive so that it may be opened under the stress of pressure or suction, as the case may be. When the plunger is forced against the blood the valve opens and blood is forced into the measuring tube to a predetermined level, for example 200 millimeters. The valve will automatically close when the plunger is immobilized in the blood collecting vessel. However, should the predetermined level be exceeded, the plunger may be retracted sufficiently to cause the valve to open and to return a sufficient quantity of blood back to the blood collecting vessel in order to obtain a precise 200 millimeter level. The blood is returned from the measuring tube to the blood collecting vessel under atmospheric pressure. The blood sedimentation rate test, more technically known as the Erythro Sedimentation Rate test (E.S.R.) may now be conducted in standard manner. The calibrated measuring tube used in this procedure is technically known as a Westergren Tube.

The foregoing procedure contrasts with the DISPETTES method of Guest Medical and with the more common procedure which will now be described. What is commonly done is to pippette or draw specially prepared blood into a Westergren Tube. Sometimes the blood is sucked into the Westergren Tube by mouth. But no matter how the transfer of blood from the primary collecting vessel to the Westergren Tube is handled, there is always the risk of transmitted disease. In the case of the DISPETTES procedure there is the risk of transmitting disease by reason of the necessity of transferring blood from the primary blood collecting vessel to the DISPETTES container. Only in the present invention is this risk eliminated since only by the claimed system is the sedimentation rate test conducted in the primary blood collecting vessel.

DESCRIPTION OF PREFERRED EMBODIMENT OF INVENTION

Figure 1:
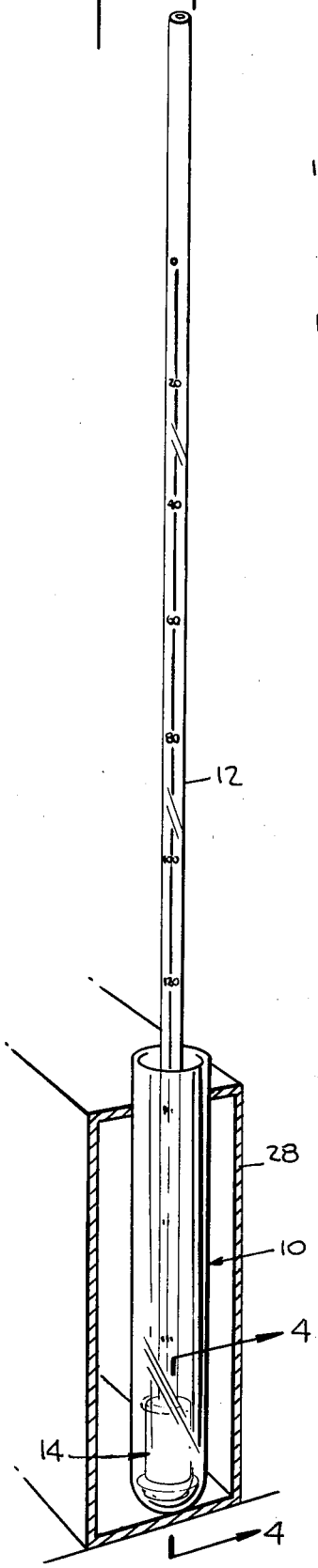
FIG. 1 is a perspective view, partly in vertical section, showing the blood sedimentation rate test means of the present invention in use, being supported by a conventional rack during the test period.
Figure 3:
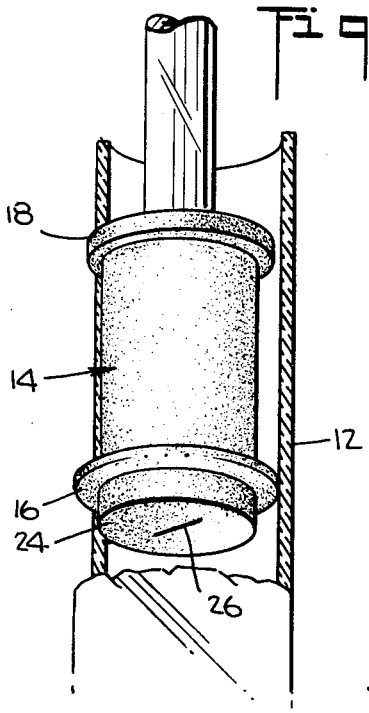
FIG. 3 is an enlarged fragmentary view, partly in vertical section, showing the outer configuration of the plunger.

As is clearly shown in the accompanying drawing, the present invention involves the use of the following component elements: a primary blood collecting vessel 10 of any conventional form, a Westergren calibrated measuring tube 12, and a plunger 14 which, as has above been stated, embodies valve means operating between the primary blood collecting vessel 10 and the Westergren Tube 12. For illustrative purposes, the primary blood collecting vessel may be described as having the general form of a test tube, cylindrical in shape, closed at the bottom and open at the top. Plunger 14 is proportioned to fit the inner cross-sectional dimension of blood collecting vessel 10. As will be seen, plunger 14 is generally cylindrical in shape, hollow, and provided on its external circumference with at least one annular flange 16. Annular flange 16 is situated adjacent the lower end of the plunger. In the preferred form of the invention a second annular flange 18 is also provided, this flange being situated at the upper end of the plunger. The inner chamber 20 which the hollow plunger defines adapts the plunger to receive the lower end of the Westergren Tube 12.

Plunger 14 is made of a resilient, rubbery material, for example, natural latex rubber or synthetic rubber suited for sealing purposes. Lower flange 16 engages the inner cylindrical surface of the blood collecting vessel 10 and provides a liquid-tight seal between the plunger and the vessel wall. The upper flange 18 may also function as a seal but its primary purpose is to stabilize and center the plunger relative to the blood collecting vessel. In this connection it will be understood that the two flanges are coaxial and concentric with the main body of the plunger and especially the inner chamber 20 which it defines.

Annular or helical corrugations 22 are formed on the inner cylindrical wall of plunger 14. The crests of these corrugations are engageable with the outer cylindrical surface of the Westergren Tube 12. As will be understood, the diameter defined by the crests of corrugations 22 is slightly smaller than the outer diameter of the Westergren Tube and consequently the corrugations will elastically and frictionally engage and hold the Westergren Tube once it is inserted into the inner chamber 20.

It will also be noted that extending across the lower end of plunger 14 is a web or diaphragm 24. This web is relatively thin, e.g., 0.020", it is relatively flexible and it is provided with a normally closed perforation, for example, in the form of a slit 26. This slit is normally closed when there is no external stress upon the web. In effect therefore plunger 14 is closed at the bottom by means of web 24 and this condition will prevent the passage of blood either into or out of the plunger or the Westergren Tube supported therein.

In the operation of the above described device, blood is drawn directly from the patient's body into the blood collecting vessel 10 and the blood remains therein for the duration of the sedimentation rate test. The blood is prepared for the test by introducing appropriate additives, for example, sodium chloride (0.85%) or sodium citrate (3.8%). As an illustration, 0.24 ml of 0.85% sodium chloride or 0.24 ml of 3.8% sodium citrate is added to approximately 0.96 ml of blood, the total volume of the prepared blood being approximately 1.2 ml. It is important to note that the procedure of the present invention does not require precise measurement of the blood volume except to the extent that such measurement is needed for determining the exact concentration of the added anticoagulant.

Figure 4:
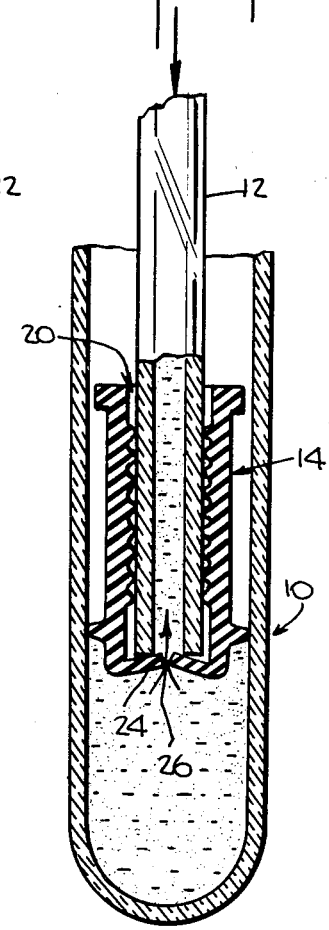
FIG. 4 is an enlarged, fragmentary section on the line 4—4 of FIG. 1, showing the plunger construction, a calibrated measuring tube mounted therein, and the valve slit open to pass blood into the calibrated measuring tube when the plunger is pushed downwardly against the blood in the blood collecting vessel.
Figure 5:
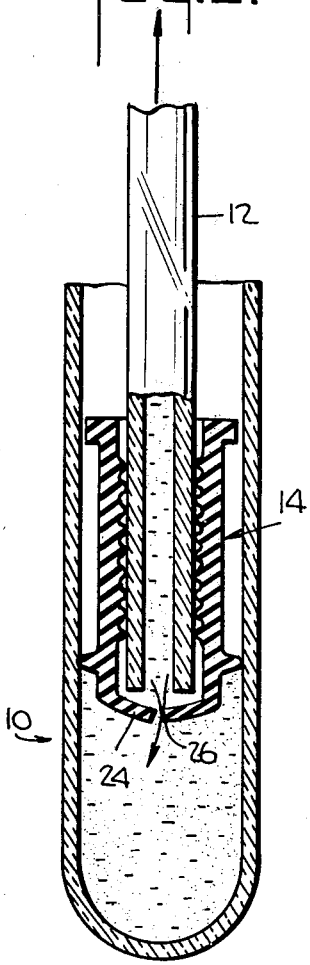
FIG. 5 is a view similar to that of FIG. 4, but showing the valve slit opening in the opposite direction to pass blood back from the calibrated measuring tube to the blood collecting vessel when the plunger is moved in upward direction.

After the blood is prepared in the blood collecting vessel as last above described, the Westergren Tube 12 with its lower end inserted in plunger 14 is introduced into the blood collecting vessel 10. With the Westergren Tube used as a holder or handle, plunger 14 is caused to move downwardly in the blood collecting vessel until its web 14 engages the prepared blood therein. Further downward movement of the plunger causes the blood to flex web 14 upwardly and thereby to stretch said web and open its slit 26. See FIG. 4. Further downward movement of the plunger forces the blood up into the Westergren Tube until it reaches the zero calibration. Assuming that the blood level in the Westergren Tube is precisely at the zero calibration, the plunger is immobilized relative to the blood collecting tube and, since there is a balance of forces on opposite sides of web 24, said web will resume its unstretched condition and its slit will close, thereby preventing further passage of the blood in either direction between the blood collecting vessel and the Westergren Tube. Should it be found that the blood level has exceeded the zero calibration, it may be lowered by the simple expedient of retracting the plunger sufficiently to develop negative pressure upon the lower surface of the web and atmospheric pressure upon its upper surface. This will cause the web to flex downwardly and to stretch, and thereby to open the slit for the return of blood from the Westergren Tube to the blood collecting vessel. See FIG. 5. This reverse movement of the blood takes place under atmospheric pressure. Once again when the blood level coincides with the zero calibration the plunger is stabilized and the balancing of forces on opposite sides thereof will remove the stretch which had opened the slit. The slit closes and further passage of blood between the Westergren Tube and the blood collecting vessel is prevented.

Figure 6:
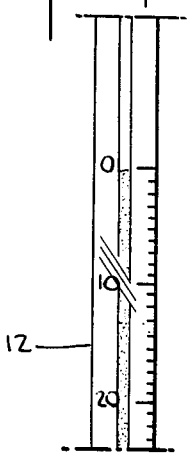
FIG. 6 is a fragmentary view of the calibrated measuring tube showing the blood level at the zero calibration at the beginning of the sedimentation rate test.
Figure 7:
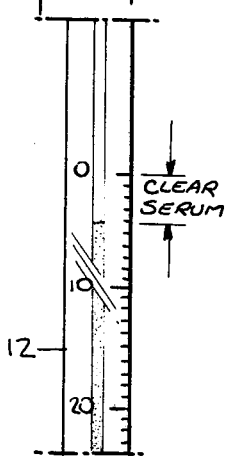
FIG. 7 is a view similar to that of FIG. 6 but showing the sedimentation drop at end of test period.
Figure 2:
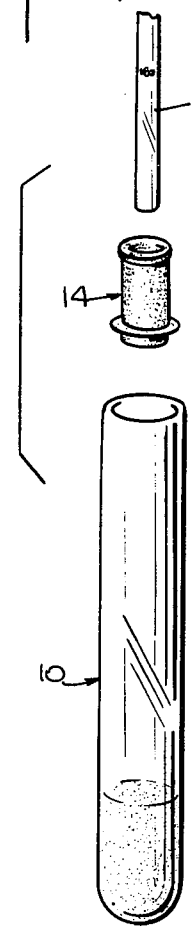
FIG. 2 is a perspective, exploded, fragmentary view showing the several component parts of the blood sedimentation rate test means.

The procedure which follows the above described steps is conventional. The blood collecting vessel is placed in a rack 28 and allowed to remain there for a predetermined period time following which a sedimentation rating is taken. See FIGS. 6 and 7 which show the condition of the blood at the beginning and end of the test period.

It will now be understood that web 24 with its slit 26 performs the function of a pressure actuated, two-way, diaphragm valve. This of course is a purely illustrative form of valve and other two-way valves suited for the purpose may also be used. It should also be understood that the invention is not limited to the Westergren test procedure. It may also be applied, for example, to a modified form of Wintrobe method wherein a modified Wintrobe tube is used. Normally a Wintrobe tube is closed at one end and open at the opposite end and it has a calibrated scale from 0 to 100 mm. When applied to the present invention the Wintrobe tube would be open at both ends, precisely as is shown with respect to the Westergren tube, but its scale would remain calibrated 0–100 mm.

The foregoing description is intended to illustrate the present invention without limiting its applications except to the extent of the limitations of the appended claims.

We claim:

1. Blood sedimentation rate test means, comprising:

(a) a blood collecting vessel, (b) a plunger in said vessel, movable axially thereof, (c) a calibrated measuring tube extending into said collecting vessel and connected to said plunger for axial movement therewith, and (d) pressure actuated, normally closed valve means in said plunger operative between said collecting vessel and said measuring tube, (e) said valve means being adapted to open when the measuring tube is manually moved relative to the collecting vessel to push the plunger against the blood collected therein, (f) whereby blood is forced out of the collecting vessel, through the open valve means, and into the measuring tube until it attains a predetermined level therein, (g) said valve means being adapted to close and to confine the displaced blood to the measuring tube when said measuring tube and its connected plunger are immobilized relative to the collecting vessel, (h) the valve means being adapted to open under negative pressure when the measuring tube and its connected plunger are retracted relative to the collecting vessel, (i) whereby, in the event the blood level in the measuring tube is higher than the predetermined level, blood may be returned to the collecting vessel under atmospheric pressure, (j) said valve means being adapted to close when the measuring tube and connected plunger are again immobilized.

2. Blood sedimentation rate test means in accordance with claim 1, wherein:

(a) the blood collecting vessel comprises a cylindrical tube open at the top and closed at the bottom, and (b) the plunger comprises a tubular body, open at the top, with at least one annular flange formed thereon, extending radially outwardly therefrom and circumferentially thereof, (c) said tubular body and annular flange being formed integrally with each other of resilient material, (d) whereby the tubular body is adapted to receive and resiliently retain the lower end of the measuring tube, and (e) the annular flange is adapted to resiliently engage the inner surface of the collecting vessel to provide a liquid-tight seal between said collecting vessel and said tubular body.

3. Blood sedimentation rate test means in accordance with claim 2, wherein:

(a) the valve means comprises a perforated web formed on said tubular body and extending across its lower end, (b) said web being formed integrally with said tubular body of the same resilient material, (c) the perforation in said web being normally closed by reason of the elasticity of said resilient material, and being adapted to open on flexing of the web when the plunger is pushed against, or retracted from, the blood in the collecting vessel.

4. Blood sedimentation rate test means in accordance with claim 3, wherein:

the tubular body, annular flange, and perforated web are molded of rubber.

5. Blood sedimentation rate test means in accordance with claim 3, wherein:

(a) a second annular flange is provided on the tubular body a spaced distance from the first flange, (b) said first flange being situated adjacent the lower end of the tubular body, (c) the second flange being situated adjacent the upper end of the tubular body, and (d) both flanges being concentric with the tubular body to center said tubular body and the measuring tube therein relative to the collecting vessel.

* * * * *